US012247370B2

(12) United States Patent
Queen

(10) Patent No.: US 12,247,370 B2
(45) Date of Patent: Mar. 11, 2025

(54) HIGH-CAPACITY THREADED BAR MICROPILE AND CAISSON REINFORCEMENT COMPRESSION SPACER

(71) Applicant: Foundation Technologies, Inc., Lawrenceville, GA (US)

(72) Inventor: Frank A. Queen, Dacula, GA (US)

(73) Assignee: FOUNDATION TECHNOLOGIES, INC., Lawrenceville, GA (US)

( * ) Notice: Subject to any disclaimer, the term of this patent is extended or adjusted under 35 U.S.C. 154(b) by 118 days.

(21) Appl. No.: 17/740,404

(22) Filed: May 10, 2022

(65) Prior Publication Data

US 2022/0356664 A1 Nov. 10, 2022

Related U.S. Application Data

(60) Provisional application No. 63/186,517, filed on May 10, 2021.

(51) Int. Cl.

| | |
|---|---|
| ***E02D 5/54*** | (2006.01) |
| ***E02D 5/38*** | (2006.01) |
| ***E02D 5/72*** | (2006.01) |

(52) U.S. Cl.

CPC ..... *E02D 5/54* (2013.01); *E02D 5/38* (2013.01); *E02D 5/72* (2013.01); *E02D 2300/0015* (2013.01); *E02D 2300/002* (2013.01); *E02D 2300/0034* (2013.01); *E02D 2600/20* (2013.01); *E02D 2600/30* (2013.01)

(58) Field of Classification Search

CPC ..... E02D 5/54; E02D 5/38; E02D 2300/0015; E02D 2300/002; E02D 2300/0034; E02D 2600/20; E02D 5/72; E02D 2600/30; E02D 27/12; E04H 12/22

USPC ..... 52/707, 708, 683, 682; 405/257, 254, 405/231, 165

See application file for complete search history.

(56) References Cited

U.S. PATENT DOCUMENTS

| | | | | | |
|---|---|---|---|---|---|
| 839,829 | A * | 1/1907 | Fell | E04H 12/2276 | 52/297 |
| 1,080,283 | A * | 12/1913 | Kenny | E04D 9/00 | 52/750 |
| 1,258,482 | A * | 3/1918 | Shuman | E02D 5/36 | 405/233 |
| 1,611,935 | A * | 12/1926 | Mitchell | E04H 12/2269 | 52/168 |
| 1,991,087 | A * | 2/1935 | Falcon | D06F 53/04 | 52/297 |

(Continued)

*Primary Examiner* — Brent W Herring

(74) *Attorney, Agent, or Firm* — Thomas | Horstemeyer, LLP

(57) ABSTRACT

Various examples are provided related to compression spacers which can be utilized in the construction of, e.g., a micropile or drilled shaft. In one example, a high-capacity compression spacer includes a grout vessel body including: a grout receiving portion defined by a bottom of the grout vessel body and a portion of a sidewall of the grout vessel body; a bar receiving portion extending from the grout receiving portion to a lip defining an opening of the grout vessel body; and a plurality of tie wire insertion holes distributed about the bar receiving portion. Each of the plurality of tie wire insertion holes can be configured for insertion of a tie wire. The grout vessel body can be a single piece, molded body. The grout receiving portion can be filled with a high-strength, non-expanding grout or concrete.

16 Claims, 7 Drawing Sheets

(56) References Cited

U.S. PATENT DOCUMENTS 2,080,493 A * 5/1937 Marsden ..... E02D 7/30 405/253
3,205,634 A * 9/1965 Wagner ..... E04F 11/1812 249/DIG. 4
3,345,826 A * 10/1967 Hignite ..... E02D 5/665 175/320
4,008,550 A * 2/1977 Kaufman ..... E06C 9/00 182/87
4,618,289 A * 10/1986 Federer ..... E02D 5/385 405/239
5,090,165 A * 2/1992 Kenny ..... E04H 12/2269 52/165
5,456,051 A * 10/1995 Queen ..... E04C 5/20 52/679
5,560,588 A * 10/1996 Hilliard ..... E04G 21/3223 256/65.06
5,632,464 A * 5/1997 Aberle ..... E01F 9/685 52/298
5,707,180 A * 1/1998 Vickars ..... E21B 10/44 405/249
5,752,349 A * 5/1998 Fitzsimmons ..... A63B 71/023 52/165
6,041,559 A * 3/2000 Schickert ..... A63B 71/028 52/165
6,837,018 B1 * 1/2005 Hagel ..... E04G 23/0207 411/930
7,037,045 B2 * 5/2006 Jones ..... E02D 5/56 405/253
7,694,487 B1 * 4/2010 Ryan ..... E02D 27/42 52/297
7,854,451 B2 * 12/2010 Davis, II ..... E21B 17/046 405/252.1
8,875,469 B1 * 11/2014 Keller, Sr. ..... E02D 5/60 52/165
9,004,439 B2 * 4/2015 Gross ..... E04H 12/2269 248/507
9,181,674 B2 * 11/2015 El Naggar ..... E02D 5/36
10,801,176 B1 * 10/2020 Willson ..... E02D 5/805
11,613,886 B2 * 3/2023 Van Ee ..... F16S 5/00 52/79.1
2007/0180784 A1 * 8/2007 Smith ..... E01F 9/623 52/300
2007/0187564 A1 * 8/2007 McGuire ..... E04H 12/2261 248/346.5
2007/0209310 A1 * 9/2007 Papke ..... E04C 5/201 52/677
2008/0157521 A1 * 7/2008 Davis ..... E21B 17/046 285/331
2010/0229474 A1 * 9/2010 Estes ..... E01C 11/14 52/584.1
2010/0277290 A1 * 11/2010 Knudsen ..... E04H 12/2269 264/32
2018/0016808 A1 * 1/2018 Hilliard ..... E04F 11/1812
2020/0165790 A1 * 5/2020 Wang ..... E02D 5/38
2022/0056726 A1 * 2/2022 Milanowski ..... E04H 12/2269

* cited by examiner

HIGH-CAPACITY THREADED BAR MICROPILE AND CAISSON REINFORCEMENT COMPRESSION SPACER

CROSS REFERENCE TO RELATED APPLICATIONS

This application claims priority to, and the benefit of, U.S. provisional application entitled "High-Capacity Threaded Bar Micropile and Caisson Reinforcement Compression Spacer" having Ser. No. 63/186,517, filed May 10, 2021, which is hereby incorporated by reference in its entirety.

BACKGROUND

Root piles were conceived in Italy in the early 1950s in response to demand for innovative techniques for underpinning historic buildings and monuments that had sustained damage over time and especially during World War II. A reliable underpinning system was required to support structural loads with minimal movement and for installation in access restrictive environments with minimal disturbance to the existing structure. The conditions in postwar Europe encouraged the development of lightly reinforced, cast-in-place root pile elements which were largely designed and installed by specialty contractors on a design-build basis.

The use of root piles grew in Italy throughout the 1950 and was introduced in the UK for the underpinning of several historic structures and used in Germany on underground urban transportation projects during the 1960s. Additional engineering demands resulted in the introduction of systems of reticulated root piles. Such systems use multiple vertical and inclined root piles interlocked in a three-dimensional network, creating a laterally confined soil/pile composite structure. Reticulated root pile networks were used for slope stabilization, reinforcement of quarry walls, protection of buried structures, and other soil and structural support and ground reinforcement applications.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 4:
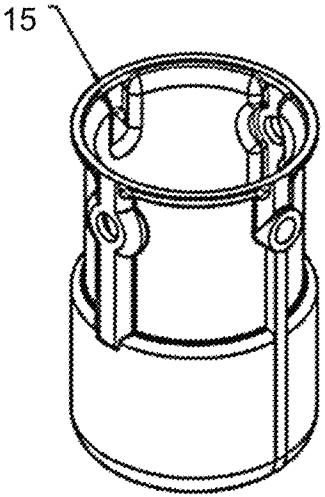
FIGS. 3 and 4 are isometric views (bottom-up and top-down) of the compression spacer of FIGS. 1 and 2, in accordance with various embodiments of the present disclosure.

Disclosed herein are various examples of systems, methods, apparatus, etc. related to compression spacers which can be utilized in the construction of, e.g., a micropile or drilled shaft. Micropiles may also be referred to as pin piles, needle pile, minipiles or small diameter caissons. Reference will now be made in detail to the description of the embodiments as illustrated in the drawings, wherein like reference numbers indicate like parts throughout the several views.

The evolution of the micropile has challenged the geotechnical construction industry to constantly re-evaluate the best and most economical use in design. Micropiles are centrally reinforced with either one or a group of bar reinforcement. Micropiles are small diameter high capacity grouted in place piles designed with steel reinforcement. The piles transfer compression, tension and lateral loads developed through the skin friction load resistance achieved between the pile and the surrounding ground. The use of continuous threaded bars (or threadbars) as single, double, and triple bar micropiles was introduced in the 1970's. Threaded bars have become the reinforcement of choice and large threaded single bar reinforcement is becoming an even more common choice in design over the utilization of smaller diameter bundled bars.

Technological advancements have contributed to the increased capacities of micropiles, which may withstand design loads in excess of 500 kips. Micropiles are utilized when difficult and challenging ground conditions and complex site conditions are involved that are either man-made or natural obstructions. They are used to replace existing deteriorating foundation systems, seismic structural retrofitting, embankment stabilization, landslide stabilization, new foundations, foundation underpinning of existing structures, structural repair, earth retention, specialty shoring and for tower foundation supports.

Today micropiles are considered deep foundation elements constructed utilizing high-strength, small diameter steel casing and threaded bars. Micropiles have distinct advantages in comparison to other types of deep foundations methodologies. They can be installed in virtually any ground condition with minimal vibration and disturbance to existing structures. Micropiles are especially advantageous because they can be installed in both soil and rock conditions, and can be installed in limited access, low-overhead environments due to the relatively small equipment needed. Substantial cost savings advantages can be realized when utilizing single larger micropile designs. Casing diameters can be minimized because the effective net cross-sectional area available for reinforcement can be optimized with a single large bar versus small bundled bars. Installing a single bar versus smaller bundled bars can also increase the rate or production.

Micropiles can be designed for a specific performance life expectancy. Micropiles with a performance life expectancy of less than 2 years are considered temporary piles, while those with a performance life expectancy from 2 to 7 years are considered semi-permanent, and those with a performance life expectancy of greater than 7 years are considered permanent. Micropiles can be tested in compression and tension for verification and proof testing. A finished micropile resists compressive, uplift/tension, and lateral loads and is typically load tested in accordance with ASTM D 1143 for compression, ASTM D 3689 for uplift/tension loads, and ASTM D 3966 for lateral load capacities.

High-capacity threaded bar micropile reinforcement compression spacers, which are also referred to as an end cap or BarBoot throughout the construction industry, were created in response to the ever-evolving design and use of micropile technology. Thread bars are used because, much like the deformations on standard bar reinforcement, there is more deformation on the bars to transfer the load into the surrounding grout body. The associated skin friction between the micropile and the earth then transfers the load from the pile grout into the earth where most of the pile's capacity is developed.

Larger threaded bar diameters can range from #20 bars (2.5-inch diameter); to #24 bars (3-inch diameter); to #28 bars (3.5-inch diameter); to as large as #32 bars (4-inch diameter). The disclosed compression spacers can provide two means of compression support for the much larger bars due to the larger diameters and the much greater per foot weight of the bars which range accordingly: #20 bar—16.7 lb./ft.; #24 bar—24.0 lb./ft.; #28 bar—32.7 lb./ft.; #32 bar—41.4 lb./ft.

Corrosion protection in the micropile construction can be significant to its performance. Micropile threaded bar reinforcement can be installed with limited or no corrosion protection, single corrosion protection or even a means of additional protection utilizing double corrosion protection methodologies. No corrosion protection is representative of a bare threaded bar encapsulated in the cementitious grout. In this scenario, any unbonded length of the threaded bar can be optionally encased with a greased sheath. Unbonded lengths or portions of the tendon are free to elongate elastically and transfer the resisting force from the bonded length to an anchorage. Single corrosion protection is where any corrosion concerns regarding the anchorage termination is considered. The greased filled sheath is utilized in this protection application. Double corrosion protection is the single corrosion protection option utilizing a pre-grouted bar inside a corrugated sheathing and incorporating a compression spacer or end cap. Utilizing the high-capacity compression spacer in this approach is innovative.

Concerns regarding the integrity at the bottom of the hole due to the construction operation and/or protection of the ends of the threaded bar from corrosion may be addressed by the compression spacer. A quality compression high-capacity, high-strength spacer or end cap solution is presented that advances the evolution of micropile designs and enhances economies of scale utilizing the larger threaded bar sizes. The high-capacity compression spacer can provide an integrated integrity component to the pile itself utilizing high-strength comparable grouts and concrete that meets or exceeds the design grouts utilized in the micropiles themselves. Examples of capacity spacer designs developed to accommodate the four largest threaded bar sizes currently available will now be discussed.

A first example (Design One) can fit #20 and #24 threadbar sizes. The market for these size bars is greater than the market for the #28 and #32 bars. A special designed vessel was created to accommodate both these sizes of bar. HDPE or other suitable molding methodologies (e.g., injection molding of HDPE or other plastics) can be used to provide an optimal design and the molding technology can be selected based upon the best high strength, durable materials available for mass production. For example, a high molecular weight polyethylene with an excellent balance of stress crack resistance, stiffness, melt strength and a very high impact strength even at low temperatures coupled with high tensile strength characteristics can be utilized.

The compression spacer should be strong enough to carry the weight of the high-strength grout after it has cured properly and upon being attached to the inserted threaded bar. The high-strength, non-shrink grout can be formulated to provide 2+ hours of workability for placement purposes utilizing retarding agents followed by a more rapidly setting cure beginning shortly thereafter. The grout can obtain its initial set in 4+ hours and its final set in 8+ hours at a room temperature.

For example, the grout can be a blend of Portland cement, micro silica and additives to create a flowable, pumpable expansive grout. The material can exhibit excellent flowability with no segregation so that consolidation is consistent throughout. The grout capable of attaining an ultimate strength in excess of 8000 psi after about 28 days.

The compression spacer coupled with a grout base (e.g., approximately 3 inches) can create a high-capacity boot for the heavy large diameter bar that is affixed to the bottom of the bar to be inserted into the micropile prior to it being grouted. The high-capacity compression spacer can create a supportive base for the bar to rest as it is being encapsulated with high-strength, non-shrink grout to complete the micropiles cylindrical construction.

A second example (Design Two) can fit the much larger and heavier #28 and #32 threadbar sizes. This design can utilize a 6-inch diameter HDPE cylinder 12-inches in height which can be filled about halfway with an accelerated 10,000 psi concrete. Four holes can be drilled below the top of the vessel (e.g., approximately 3-inches down) at equal points around cylinder. These holes can accommodate tie wire which can be threaded through the holes prior to seating the bar inside the cylinder.

Once the threaded bar is inserted and seated inside the cylinder, the threaded bar can be centered, and a quick-setting high strength, non-shrink flowable grout poured into the open annulus between the threaded bar and the interior surfaces of the cylinder. Once the high-strength grout has set up, the previously threaded tie wires can be affixed to the threaded bar itself to hold the boot in position and onto the end of the threaded bar as it is being inserted into the micropile and positioned prior to the placement of the high-strength, non-shrink grout into the submerged body of the micropile.

The examples of the compression spacer will now be discussed with respect to the drawings. FIGS. 1-5 illustrate features of the first example (Design One), and show a pre-molded compression spacer grout vessel, which is suitable for mass production and economies of scale purposes. Various views are shown for clarity and illustrative purposes.

Figure 1:
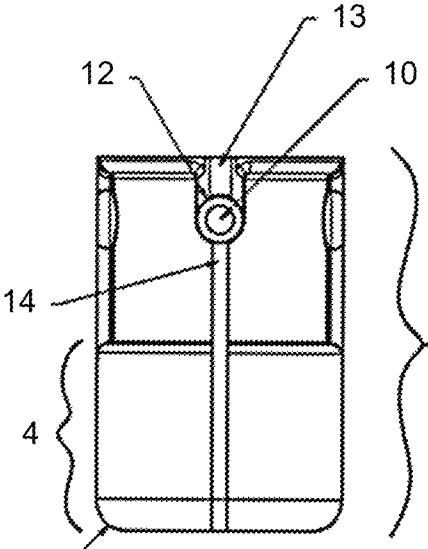

FIG. 1 is an elevation view showing a grout vessel body 3 of a compression spacer including a grout receiving portion 4 of the grout vessel body 3. The grout vessel body 3 can be molded (e.g., injection from HDPE or other appropriate material as a single integrated unit. The grout vessel body can include rounded bottom edges 7 that can make the molded vessel body 3 easier to remove from the mold as well as providing a uniform flat stable base for the bottom 8 (FIG. 3) of the grout vessel body 3. The compression spacer can include structural ribs 14 that extend vertically on the sides of the grout vessel body 3. The structural rib 14 can provide structural stability to the upper portion of the grout vessel body 3 and to the receiving open annulus end. Tie wire insertion holes 10 can be positioned about the upper portion of the grout vessel body 3 and provided with reinforcing 12 in order to prevent thin gauge tie wire secured in the insertion holes 10 from pulling through the upper portion of the grout vessel body 3. A channel reinforcement 13 can be included above the tie wire insertion hole 10 for additional structural integrity of the upper portion of the grout vessel body 3 and to provide additional room for a tie wire to be threaded through the tie wire hole 10 and up through an inner space of the channel reinforcement 13 for fixation to the threaded bar being inserted.

Figure 2:
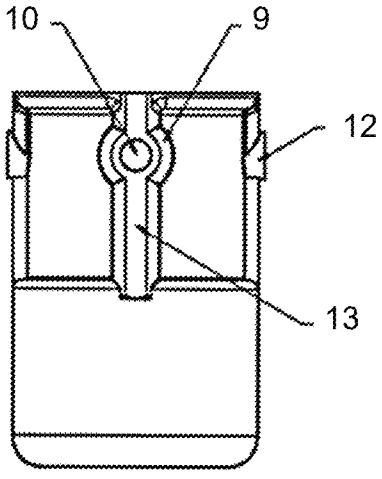
FIGS. 1 and 2 are side views of an example of a compression spacer vessel body illustrating its molded features, in accordance with various embodiments of the present disclosure.

FIG. 2 is an elevation view showing the grout vessel body 3 of the compression spacer of FIG. 1 with a 90-degree rotation, which reveals additional features of the upper half of the grout vessel body 3. The grout vessel body 3 includes a channel reinforcement 13 that continues to vertically extend down the upper portion from the tie wire insertion hole 10 down to the grout receiving portion 4 of the grout vessel body 3. The channel reinforcement 13 can also provide additional room for a tie wire to be inserted through the tie wire insertion hole 10, which is reinforced 9, and up through the inner space of the channel reinforcement 13 in order to be affixed to the threaded bar. FIG. 2 also illustrates the depth of the structural rib 14 (FIG. 1) extending from below the reinforced tie wire hole 10 (FIG. 1) above the structural rib 14 and down the length of the upper portion of the vessel body 3 to the grout receiving portion 4 of the grout vessel body 3. As shown in FIGS. 1 and 2, a combination of channel reinforcements 13 and structural ribs 14 can be used to strengthen the upper portion of the grout vessel body 3.

Figure 3:
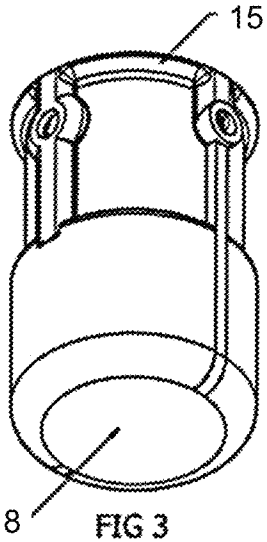

FIG. 3 is a bottom-up isometric view of the compression spacer of FIGS. 1 and 2, showing the grout vessel body 3. For clarity, FIG. 3 shows the bottom surface 8 of the grout vessel body 3 and a perspective of a reinforced lip 15 extending about the receiving open annulus end at the top of the upper portion of the grout vessel body 3. The reinforced lip 15 encompasses the receiving opening of the grout vessel body 3 in order to stiffen the top edges for receiving the threaded bar. FIG. 4 is a top-down isometric view of the pre-molded grout vessel 3 providing another perspective of the reinforced lip 15 and the inner space of the channel reinforcements 13.

Figure 5:
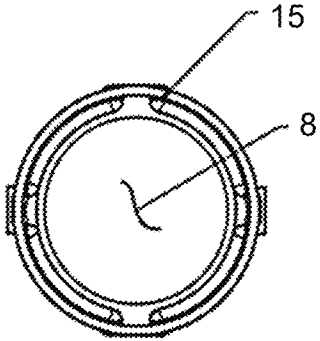
FIG. 5 is a top-down plan view of the compression spacer of FIGS. 1 and 2, in accordance with various embodiments of the present disclosure.

FIG. 5 is a plan or top-down view of the grout vessel body 3 showing another perspective of the reinforced lip 15 and the interior top surface of the bottom 8 of the grout vessel body 3. In addition, it can be seen that the receiving opening at the top of the grout vessel body 3 is the open annulus receiving end for insertion of a threaded bar. The inner space of the channel reinforcements 13 can also be seen at the 12, 3, 6 and 9 o'clock positions where the tie wire insertion holes 10 are located.

Figure 6:
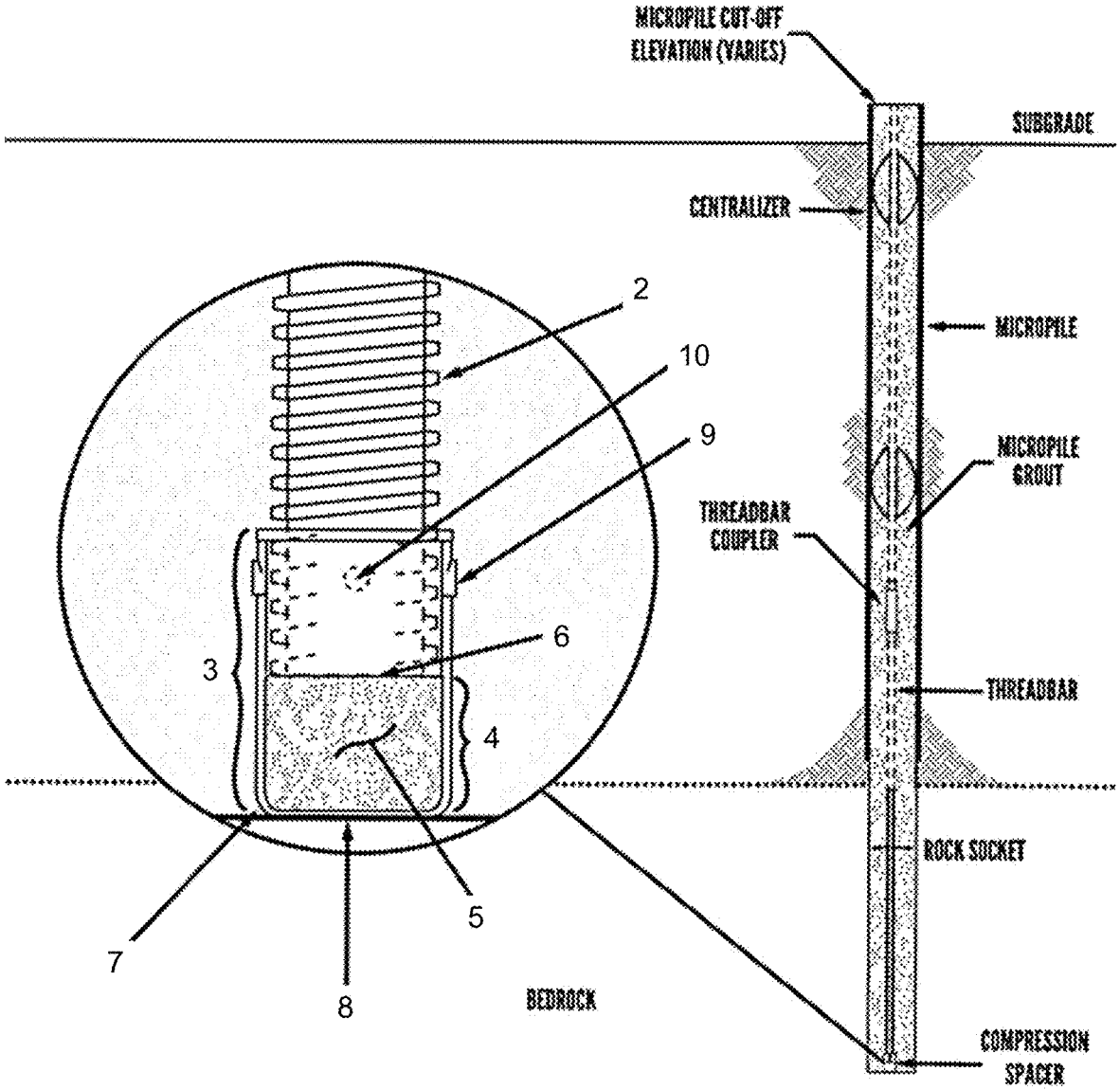
FIG. 6 is an application elevation illustrating a micropile and its components including details of the high-capacity compression spacer positioned within the micropile, in accordance with various embodiments of the present disclosure.

An application of the compression spacer of FIGS. 1-5 will now be discussed with respect to FIGS. 6-8. FIG. 6 is an elevation view of an example of a micropile 1 design application and an exploded view of the micropile 1 with a high-capacity #20 or #24 threadbar 2 inserted into the grout vessel body 3 after filling the grout receiving portion 4 of the grout vessel body 3. The grout receiving portion 4 of the grout vessel body can be at least partially filled with high-strength, non-shrink grout 5 capable of supporting the point loading weight of the #20 or #24 threadbar 2. The amount of weight to be supported will vary based upon the length of the threadbar 2 placed upon the exposed grouted bearing surface 6 within the grout receiving portion 4 of the grout vessel body 3. As shown in FIG. 6, the compression spacer is positioned at the bottom of the micropile with the threadbar 2 extending upward through the length of the micropile. As shown, multiple threaded bars may be coupled together by, e.g., a treadbar coupler and supported by the compression spacer.

Figure 7:
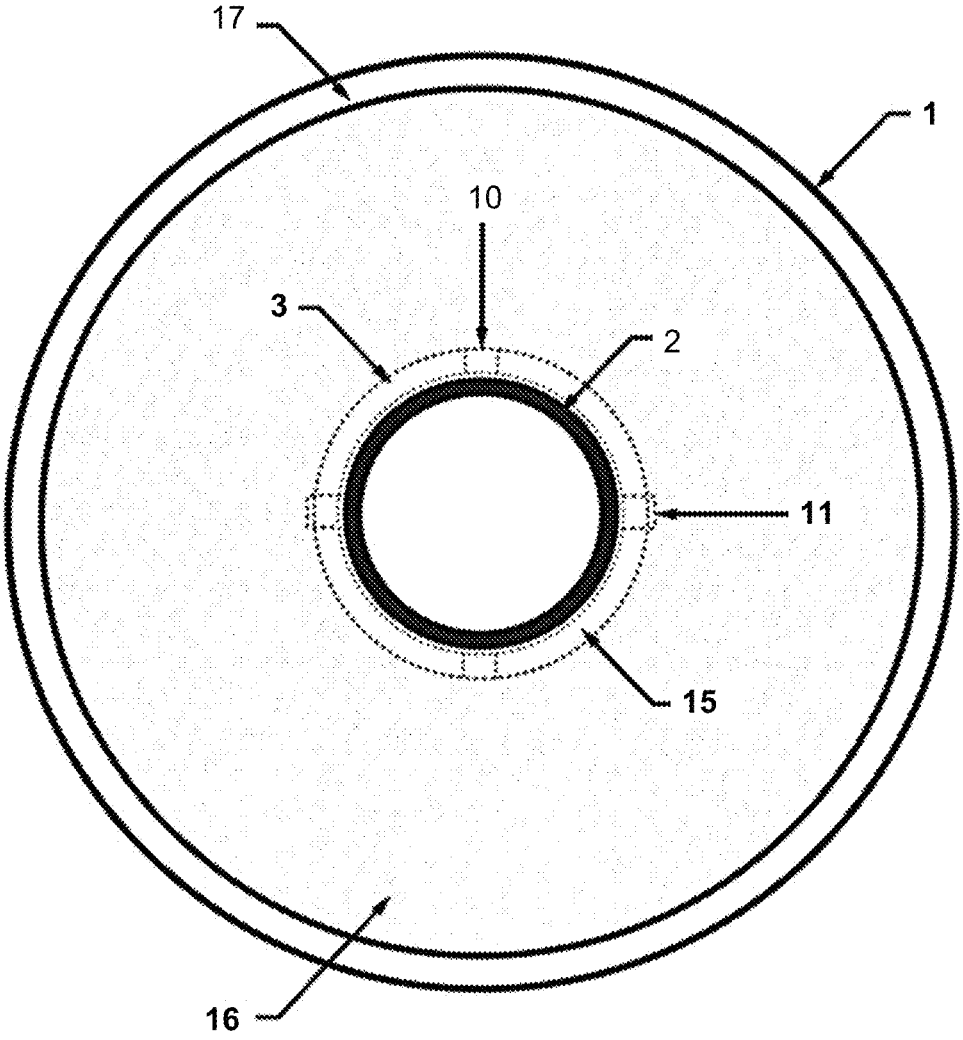
FIG. 7 is a plan view cross-section of the micropile through the high-capacity compression spacer of FIG. 6, in accordance with various embodiments of the present disclosure.
Figure 8:
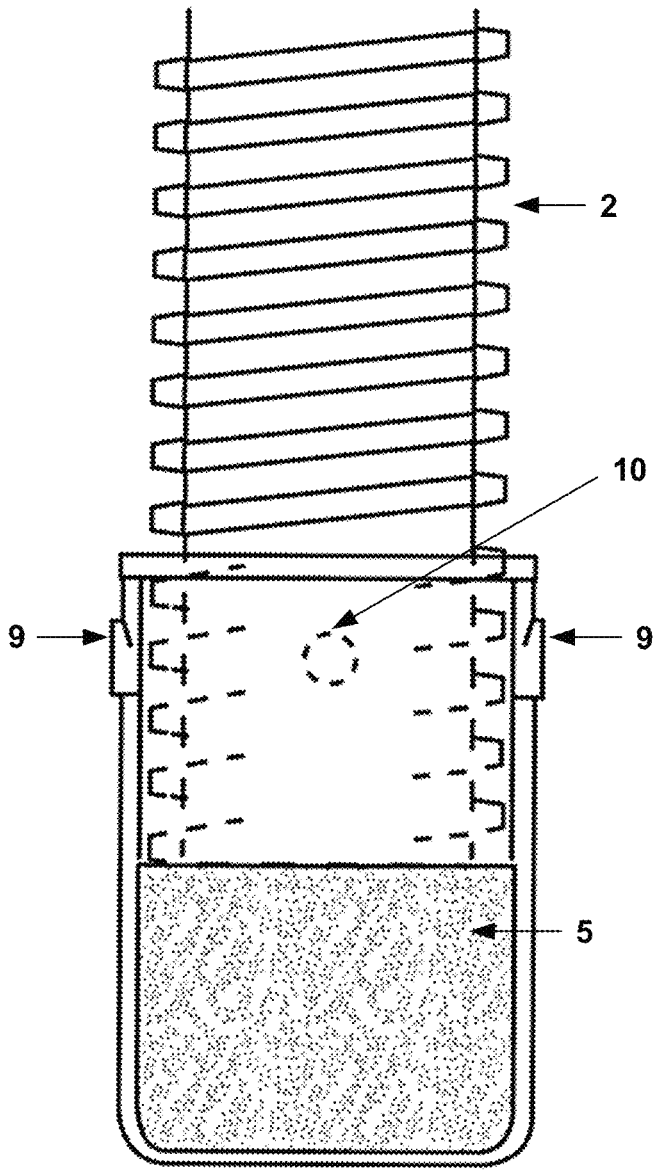
FIG. 8 is an elevation view of the high-capacity compression spacer of FIG. 6 with the threaded bar inserted, in accordance with various embodiments of the present disclosure.

FIG. 7 is a plan or top-down view of the micropile 1 showing the micropile casing 17 surrounding the micropile 1 which provides additional strength as well as a means of keeping the adjacent earth from caving into the pile during construction. A high-strength, non-expansive grout 16 can be placed within the casing 17 of the micropile 1 thus encapsulating the #20 or #24 threadbar 2 and the high-strength compression spacer to complete the micropile 1 construction. FIG. 8 provides an enlarged view of the threadbar 2 positioned within the upper portion of the compression spacer and resting on the high-strength, non-shrink grout 5.

Another application of a compression spacer will now be discussed with respect to FIGS. 9-11. Larger compression spacers comprising pre-molded grout vessel bodies 3 such as, e.g., the second example (Design Two) can be utilized to accommodate heavier and larger #28 (3.5 inch) and #32 (4 inch) threadbars 2. Mass production of high-capacity compression spacers can be taken into consideration with this design.

Figure 9:
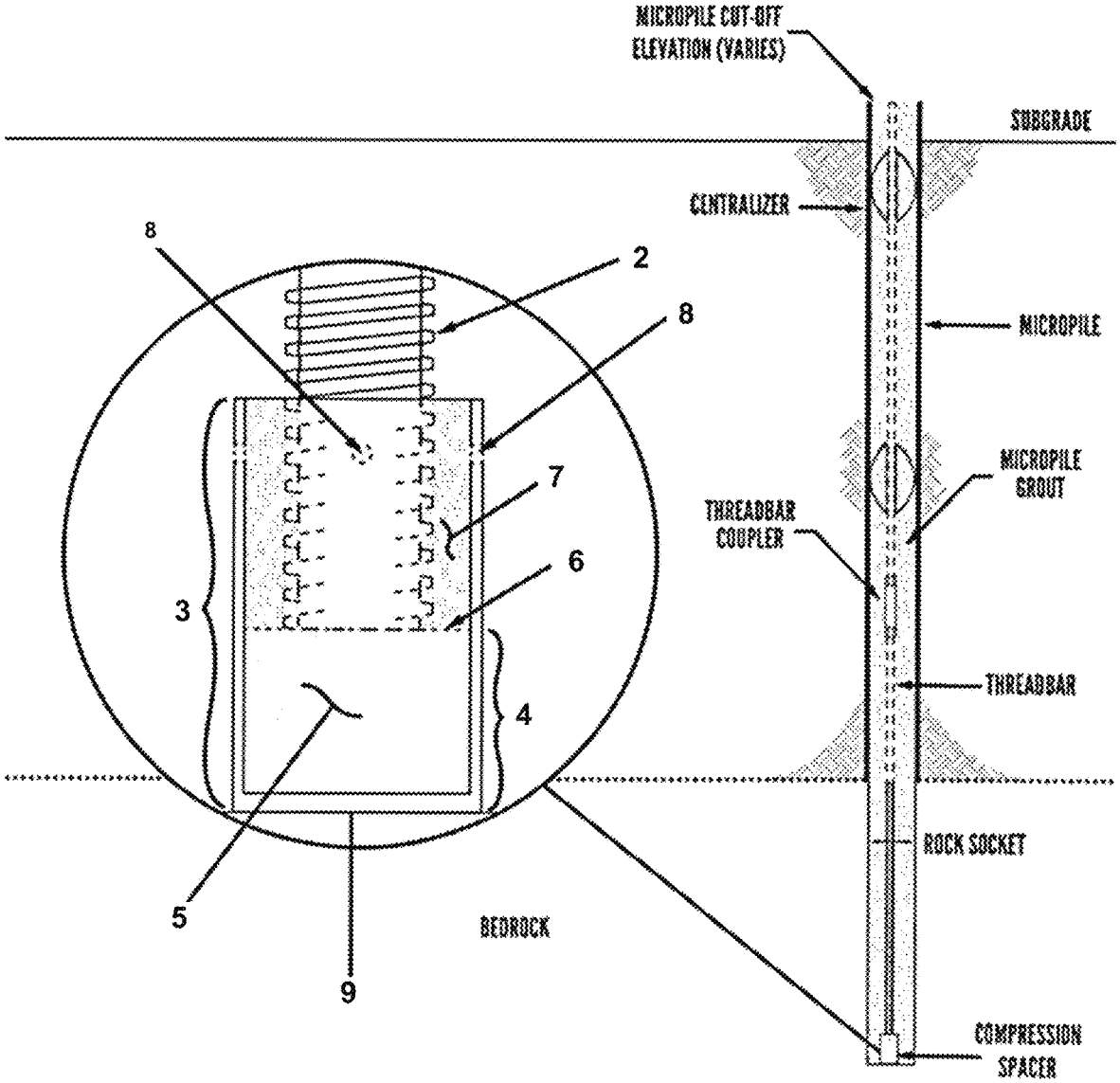
FIG. 9 an application elevation illustrating a micropile and its components including details of another high-capacity compression spacer positioned within the micropile, in accordance with various embodiments of the present disclosure.
Figure 10:
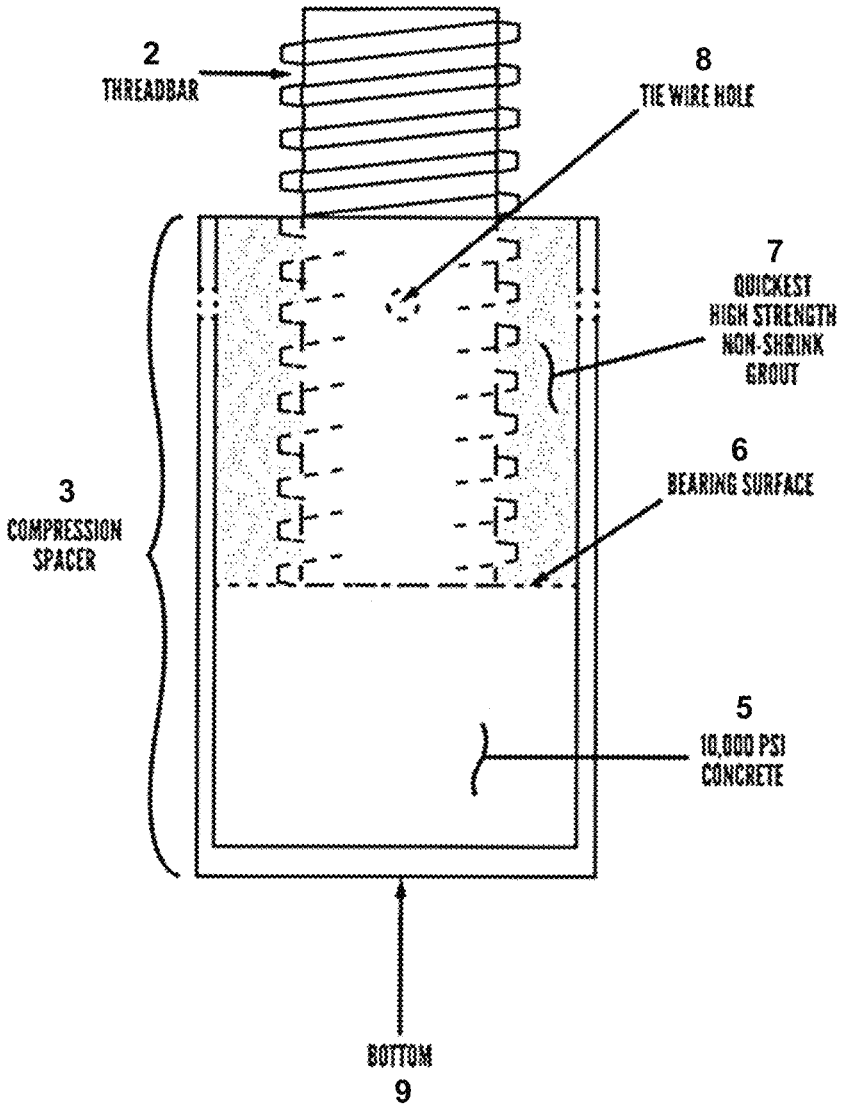
FIG. 10 is an elevation view of the high-capacity compression spacer of FIG. 9 with the threaded bar inserted, in accordance with various embodiments of the present disclosure.

FIG. 9 is an elevation view of another example of a micropile 1 design application and an exploded view of the micropile 1 with a high-capacity #28 or #32 threadbar 2 inserted into the grout vessel body 3 of the compression spacer after filling the grout receiving portion 4. The grout receiving portion 4 of the grout vessel body can be at least partially filled with high-strength concrete 5 that can be placed to a specified depth capable of supporting the heavier weights of the #28 or #32 threadbars 2 utilized in the micropile 1 design. Once the high-strength concrete 5 has reached the specified strength, tie wire insertion holes 10 can be drilled into the sides of the grout vessel body 3 at equal intervals around the threaded bar 2 and at a distance near the top of the receiving end of the grout vessel body 3 in order to receive tie wire threaded through the tie wire holes 10 for affixing to the threadbars 2.

Upon insertion of the threaded bar 2 into the upper portion of the grout vessel body 3 and with it resting upon the bearing surface 6 of the high-strength concrete 5, the open annulus between the inserted threaded bar 2 and the interior surface of the grout vessel body 3 can be filled with a high-strength, non-expansive, quick-setting grout 18. Once the high-strength, non-expansive, quick-setting grout 18 has cured, the tie wires can be affixed to the threaded bar 2 and the compression spacer inserted into the micropile 1 and lowered to the bottom of the shaft ready for the completion of the micropile 1 construction. FIG. 10 represents a larger descriptive detail of the exploded view in FIG. 9 for the #28 or #32 threadbar 2 using the example of Design Two.

Figure 11:
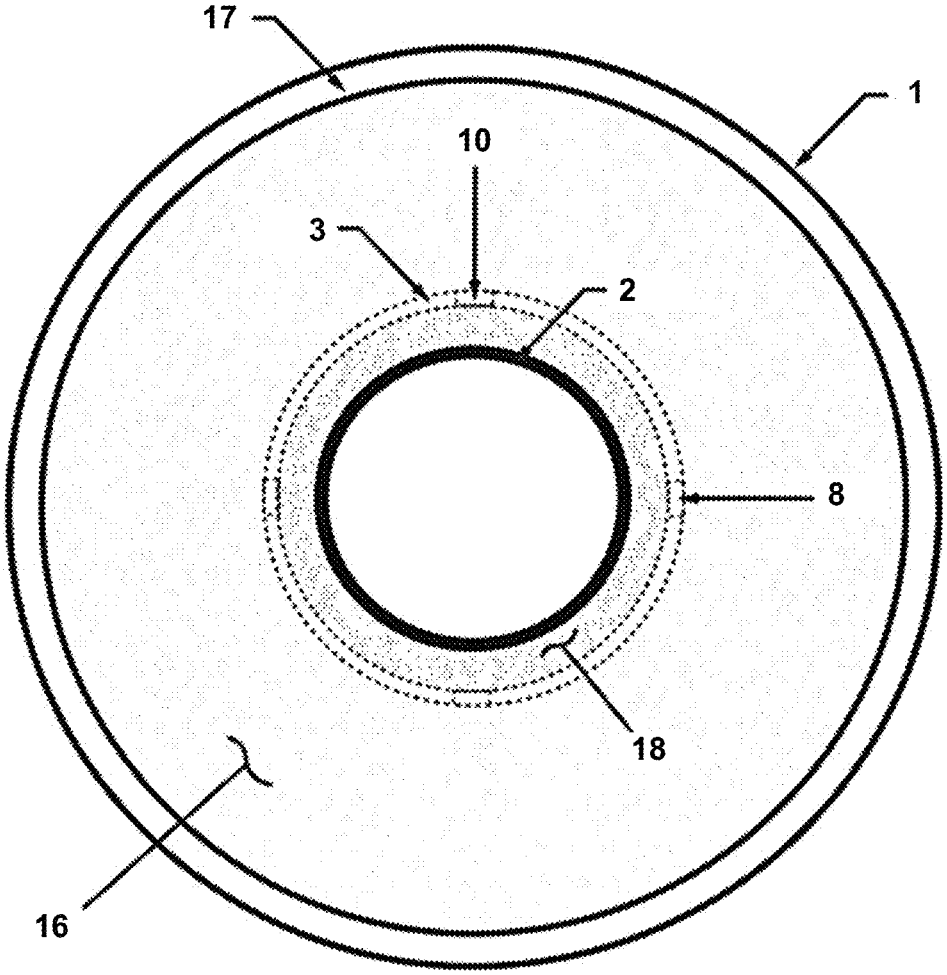
FIG. 11 is a plan view cross-section of the micropile through the high-capacity compression spacer of FIG. 9, in accordance with various embodiments of the present disclosure.

FIG. 11 is a plan or top-down view of the micropile 1 showing the micropile casing 17 surrounding the micropile 1 which provides additional strength as well as a means of keeping adjacent earth from entering into the pile during construction. This view also shows high-strength, non-expansive grout 16 placed within the casing 17 of the micropile 1 thus encapsulating the #28 or #32 threaded bar 2 which are larger in cross-sectional diameter and much heavier to support in application. The grout vessel body 3 of the high-strength compression spacer can be filled to a height within the grout receiving portion 4 to support the #28 or #32 threadbar 2 extending through the micropile 1 for clearance purposes. After the #28 or #32 threadbar 2 has been inserted into the grout vessel body 3 and is resting upon the bearing surface 6 of the high-strength concrete 5, the open annulus between the inserted threadbar 2 and the interior surface of the pre-molded compression spacer body 3 can be filled with a high-strength, non-expansive flowable grout 18.

While certain examples of compression spacers have been disclosed in detail, it is to be understood that various modifications may be adopted without departing from the spirit of the disclosure. In one or more aspects, a high-capacity compression spacer can be utilized in the construction of a micropile or drilled shaft. The high-capacity compression spacer can comprise a grout vessel body including a lower grout receiving portion and an upper bar receiving portion configured to receive a steel threadbar or bar steel reinforcement. For example, the compression spacer can be a single piece, pre-molded HDPE plastic body. The upper bar receiving portion can comprise a plurality of tie wire insertion holes configured to receive a tie wire. One or more tie wire insertion holes within the upper receiving portion can be reinforced with a solid structural rib to stiffen the upper receiving portion of the grout vessel body. Channel reinforcement can be located above the one or more tie wire insertion holes. The channel reinforcement can include an inner space for access of the tie wire. The channel reinforcement can allow for tie wire insertion and adjacent threading of the tie wire alongside the steel threadbar or bar steel reinforcement and thus allow for fixation of the high-capacity compression spacer to the steel threadbar or bar steel reinforcement, which can for example be size #20 or less in accommodation.

One or more tie wire insertion holes within the upper receiving portion can be reinforced with a full-length channel reinforcement to stiffen the upper receiving portion of the grout vessel body. The full-length channel reinforcement can extend from the lower grout receiving portion and across the tie wire insertion hole to a top lip of the upper receiving portion. The full-length channel reinforcement can provide additional structural integrity and rigidity to the grout vessel body while providing additional clearance between the steel threadbar or bar steel reinforcement for threading the tie wire for fixation to the threadbar or bar steel reinforcement. The sizing can accommodate, e.g., size #24 threadbar or bar steel reinforcement for fixation of the high capacity compression spacer to support the threadbar or bar steel reinforcement within the drilled annulus of the drilled shaft or micropile.

The grout receiving portion of the high-capacity compression spacer can be filled with a high-strength, non-expanding grout or concrete. The high-strength, non-expanding grout can provide a bearing surface in compression to support the steel threadbar or bar steel reinforcement. The base or bottom of the grout vessel body can serve to form a level bearing surface of the high-strength, non-expanding grout or concrete to transfer the weight of the steel threadbar or bar steel reinforcement to the bottom of a micropile or drilled shaft excavation. Reinforced tie wire receiving holes can provide resistance to tearing through the sides of the grout vessel body as the high-capacity compression spacer is affixed to the steel threadbar or bar steel reinforcement and being lowered into the open annulus of the drilled shaft of micropile. The upper bar receiving portion can be reinforced with a rigid lip around the circumference of the opening for stability and continuity of the open annulus of the receiving end of said high-capacity compression spacer.

In some aspects, a high-capacity compression spacer utilized in the construction of a micropile or drilled shaft can comprise a cylinder body having a bottom on one end and an open annulus on the opposing end. For example, the compression spacer can be a single piece, pre-molded HDPE plastic body. High-strength concrete can be placed into the bottom of the cylinder to a specified depth providing a space between the end of a steel threadbar or bar steel reinforcement and the bottom of a drilled shaft of the micropile. The concrete can be designed to provide higher strengths in order to support the weight of the much larger diameters and heavier weights of, e.g., size #28 and #32 steel threadbar reinforcement. The cylinder body with specified high strength concrete can then be placed beneath the steel threadbar reinforcement until the threadbar reinforcement is bearing upon the high-strength concrete within the cylinder. Tie wires can be inserted through holes drilled into the sides of the upper portions of the cylinder body. The open annulus between the external surfaces of the steel threadbar reinforcement and the inside surface of the cylinder body can then be filled with quick setting high-strength, non-shrink grout. Upon the curing of the quick setting high-strength, non-shrink grout, the inserted tie wires can be affixed to the steel threadbars further securing the compression spacer to the steel threadbar for lowering into the open annulus of the micropile. The tie wires can support the compression spacer as it is lowered to the bottom of the drilled shaft and positioned centrically within the shaft annulus while resting upon the bottom of the excavation. The micropile high strength, non-shrink grout can then placed into and throughout the open annulus of the body of the drilled shaft completing the construction process of said drilled shaft.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A high-capacity compression spacer, comprising:

a grout vessel body comprising a solid bottom surface and a sidewall encircling the solid bottom surface, the solid bottom surface substantially planar, the grout vessel body including:

a grout receiving portion defined by the solid bottom surface of the grout vessel body and a first portion of the sidewall of the grout vessel body, the first portion of the sidewall extending from the solid bottom surface to a second portion of the sidewall;

a bar receiving portion extending from the grout receiving portion to a lip defining an opening of the grout vessel body, the bar receiving portion defined by the second portion of the sidewall extending from the first portion of the sidewall to the lip; and a plurality of tie wire insertion holes distributed about the bar receiving portion, each of the plurality of tie wire insertion holes configured for insertion of a tie wire.

2. The high-capacity compression spacer of claim 1, wherein at least one of the plurality of tie wire insertion holes is reinforced by a structural rib extending from the grout receiving portion to that tie wire insertion hole and channel reinforcement extending between that tie wire insertion hole and the lip.

3. The high-capacity compression spacer of claim 1, wherein at least one of the plurality of tie wire insertion holes is reinforced by a full-length channel reinforcement extending from the grout receiving portion to the lip, the full-length channel reinforcement extending across that tie wire insertion hole.

4. The high-capacity compression spacer of claim 1, wherein the grout vessel body is a single piece, molded body.

5. The high-capacity compression spacer of claim 4, wherein the grout vessel body is molded of HDPE plastic.

6. The high-capacity compression spacer of claim 1, wherein the grout receiving portion is at least partially filled with a high-strength, non-expanding grout or concrete.

7. The high-capacity compression spacer of claim 6, wherein an end of a threaded bar or bar steel reinforcement is positioned on and supported by a bearing surface of the high-strength, non-expanding grout or concrete through the opening of the grout vessel body.

8. The high-capacity compression spacer of claim 7, wherein the threaded bar is a #20 threadbar, a #24 threadbar, a #28 threadbar or a #32 threadbar.

9. The high-capacity compression spacer of claim 7, wherein the threaded bar or bar steel reinforcement is surrounded by a high-strength, non-expanding grout filling the bar receiving portion of the grout vessel body.

10. The high-capacity compression spacer of claim 6, wherein the solid bottom surface of the grout vessel body forms a level bearing surface of the high-strength, non-expanding grout or concrete opposite the bar receiving portion.

11. The high-capacity compression spacer of claim 6, wherein the high-strength, non-expanding grout or concrete transfers a weight of a threaded bar or bar steel reinforcement positioned on and supported by a bearing surface of the high-strength, non-expanding grout or concrete to a bottom of a micropile or drilled shaft excavation.

12. The high-capacity compression spacer of claim 1, wherein the lip defining an opening of the grout vessel body is a reinforced lip.

13. The high-capacity compression spacer of claim 12, wherein the lip is shaped to facilitate insertion of a threaded bar or bar steel reinforcement.

14. The high-capacity compression spacer of claim 1, wherein at least one of the plurality of tie wire insertion holes comprises channel reinforcement extending between the at least one tie wire insertion hole and the lip, the channel reinforcement comprising an inner space forming a channel extending along an inner surface of the bar receiving portion from the at least one tie wire insertion hole to the lip.

15. A high-capacity compression spacer, comprising:

a grout vessel body including:

a grout receiving portion defined by a bottom of the grout vessel body and a portion of a sidewall of the grout vessel body;

a bar receiving portion extending from the grout receiving portion to a lip defining an opening of the grout vessel body;

a plurality of tie wire insertion holes distributed about the bar receiving portion, each of the plurality of tie wire insertion holes configured for insertion of a tie wire; and one or more tie wires inserted through one or more corresponding tie wire insertion holes of the plurality of tie wire insertion holes and secured to a threaded bar or bar steel reinforcement.

16. The high-capacity compression spacer of claim 15, wherein reinforcement of the plurality of tie wire insertion holes resists tearing when a high-compression spacer is supported by the threaded bar or bar steel reinforcement through the one or more tie wires.

* * * * *